US006547357B1

(12) United States Patent
Tsuruoka

(10) Patent No.: US 6,547,357 B1
(45) Date of Patent: Apr. 15, 2003

(54) INK JET RECORDING APPARATUS AND METHOD OF DRIVING THE SAME

(75) Inventor: Yuji Tsuruoka, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/217,986

(22) Filed: Dec. 22, 1998

(30) Foreign Application Priority Data

Dec. 25, 1997 (JP) ..... 9-357305

(51) Int. Cl.[7] ..... B41J 29/38
(52) U.S. Cl. ..... 347/14; 347/10; 347/11
(58) Field of Search ..... 347/19, 14, 12, 347/11, 17, 10, 60

(56) References Cited

U.S. PATENT DOCUMENTS 4,910,528 A * 3/1990 Firl et al. ..... 347/17
5,036,337 A 7/1991 Rezanka
5,485,182 A * 1/1996 Takayanagi et al. ..... 347/17
6,126,260 A * 10/2000 Lan et al. ..... 347/11
6,139,125 A * 10/2000 Otsuka et al. ..... 347/11

FOREIGN PATENT DOCUMENTS

| | | |
|---|---|---|
| EP | 0 496 525 | 7/1992 |
| EP | 0 526 223 | 2/1993 |
| EP | 0 750 988 | 1/1997 |
| JP | 63-42871 | 2/1988 |
| JP | 2-74351 | 3/1990 |

* cited by examiner

*Primary Examiner*—Thinh Nguyen
*Assistant Examiner*—Ly T Tran
(74) *Attorney, Agent, or Firm*—Fitzpatrick, Cella, Harper & Scinto

(57) ABSTRACT

In order to correct variations in the head temperature controlling due to variations in temperature sensing accuracy of a head temperature sensor, an ink jet recording apparatus and a method driving the same according to the present invention have pulse generating devices which can generate a plurality of signal trains of pulse widths corresponding to head temperature and devices for selecting a signal train in accordance with correction accuracy of an output of the head temperature sensor.

18 Claims, 10 Drawing Sheets

INK JET RECORDING APPARATUS AND METHOD OF DRIVING THE SAME

BACKGROUND OF THE INVENTION

1. Field of the Invention

The present invention relates to an ink jet recording apparatus in which ink is discharged on a recording material for recording.

2. Description of the Related Art

The term "recording" described in the present invention does not only refer to the transfer of a significant image such as a character or a figure to a recording material but also to the transfer of a non-significant image such as a pattern.

Techniques in accordance with the present invention are applicable to recording apparatuses such as printers, copying machines, facsimile machines having a communication system, and word-processors having a printer for recording on recording materials such as paper, string, fiber, cloth, leather, metal, plastics, glass, wood, and ceramics, and further applicable to an industrial recording apparatus combined with various processing apparatuses.

In one conventional type of ink jet head, bubbles are formed in ink by the heat generated by applying a driving pulse to an electro-thermal converting element (recording element), and resultant ink droplets are discharged onto a recording material, this so called "single-pulse driving", in which one droplet is discharged in accordance with one pulse as shown in FIG. 9A, has been mainstream. In single-pulse driving, however, by printing continuously with a high-duty cycle so that the temperature of the head increases resulting in an increase volume of discharged ink, there are cases in which printing quality has been degraded.

Accordingly, double-pulse driving has been developed, as disclosed in Japanese Patent Laid-Open Publication 63-42871 and Japanese Patent Laid-Open Publication 2-74351, in which the driving pulse is divided into a pre-pulse and a main pulse, as shown in FIG. 9B. By changing a pulse width and an off-time between the two pulses, the volume of discharged ink is controlled.

On the other hand, when applying a single pulse to an electro-thermal converting element (heater) to form an ink droplet into a bubble, it is generally known that a threshold pulse width "Tth", at which a bubble is generated on the surface of the electro-thermal converting element, decreases almost linearly with an increase in the head temperature, as shown in FIG. 6.

With so-called "Tth control" the width of the driving pulse is reduced in accordance with increase in the head temperature by monitoring the head temperature. When a sensor of the head temperature has poor accuracy, however, the driving pulse to discharge a necessary volume of ink misaligns resulting in an unstable discharge, or no ink discharge in the worst case. The pulse width, therefore, has to be increased more than the necessary width by adding a safety margin.

Since further increases in resolution and throughput of printers have recently been required, the number of nozzles of a recording head and discharging frequency must be further increased. Because of increased energy per unit time required for an increased number of nozzles and discharging frequency, however, the rate of increase in temperature is much more raised than ever.

In the ink jet head, when the head temperature is raised above a specific temperature, bubbles are prone to accumulate in the pathway of the head and bubbles generated once by driving the electro-thermal converting element may not be diminished causing disturbance of the charging. It is necessary, therefore, to retain the head temperature within a specific level for normal recording. Then, if the recording head temperature is raised above the specific level, while recording, the temperature is lowered by setting a pause, by reducing the printing frequency, or by reducing the printing duty, for suppressing increase in the head temperature. This, however, results in a decrease in throughput of the printer.

SUMMARY OF THE INVENTION

In order to solve the above-mentioned problems, an ink jet recording apparatus in accordance with one aspect of the present invention comprises a recording head having a recording element for jetting ink and sensing means for sensing temperature; pulse generating means which generates a pulse signal to be applied to the recording element of the recording head such that the pulse width of the pulse signal corresponds to the head temperature; and driving means for driving the recording element of the recording head by the pulse signal generated by the pulse generating means, wherein the pulse generating means is capable of generating a plurality of signal trains of pulse widths corresponding to the head temperature, and wherein the ink jet recording apparatus further comprises means for changing the signal train corresponding to correction accuracy of the output of the temperature sensing means of the recording head.

In accordance with another aspect of the present invention, an ink jet recording apparatus comprises sensing means for sensing temperature of a head; driving pulse storing means storing driving pulse waveform data in accordance with each range of the head temperature; driving pulse generating means which reads driving pulse waveform data corresponding to head temperature from the driving pulse storing means to generate a driving pulse waveform; and driving means for driving the head in accordance with the driving waveform generated by the driving pulse generating means, wherein the ink jet recording apparatus comprises a plurality of the driving pulse storing means to select desired driving pulse storing means in accordance with correction accuracy of a temperature characteristic of the sensing means for sensing head temperature.

In accordance with still another aspect of the present invention, a driving method of an ink jet recording apparatus having a recording head including a recording element for jetting ink and sensing means for sensing temperature, the driving method comprises the steps of:

generating a pulse signal to be applied to the recording element such that the pulse width of the pulse signal corresponds to head temperature; and driving the recording element of the recording head by the pulse signal, wherein a plurality of signal trains of pulse widths are capable of being generated in accordance with head temperature for selection of the train in accordance with correction accuracy of an output of the sensing means for sensing head temperature.

In the present invention, the head driving energy can be restrained with a corresponding to improvement in correction accuracy of the head temperature sensor by determining a relation between the head temperature and the driving pulse waveform (a table) corresponding to correction accuracy of the head temperature sensor. This may result in suppression of increase in the head temperature and restraint of degradation of throughput when recording at high duty.

DESCRIPTION OF THE PREFERRED EMBODIMENTS

Figure 1:
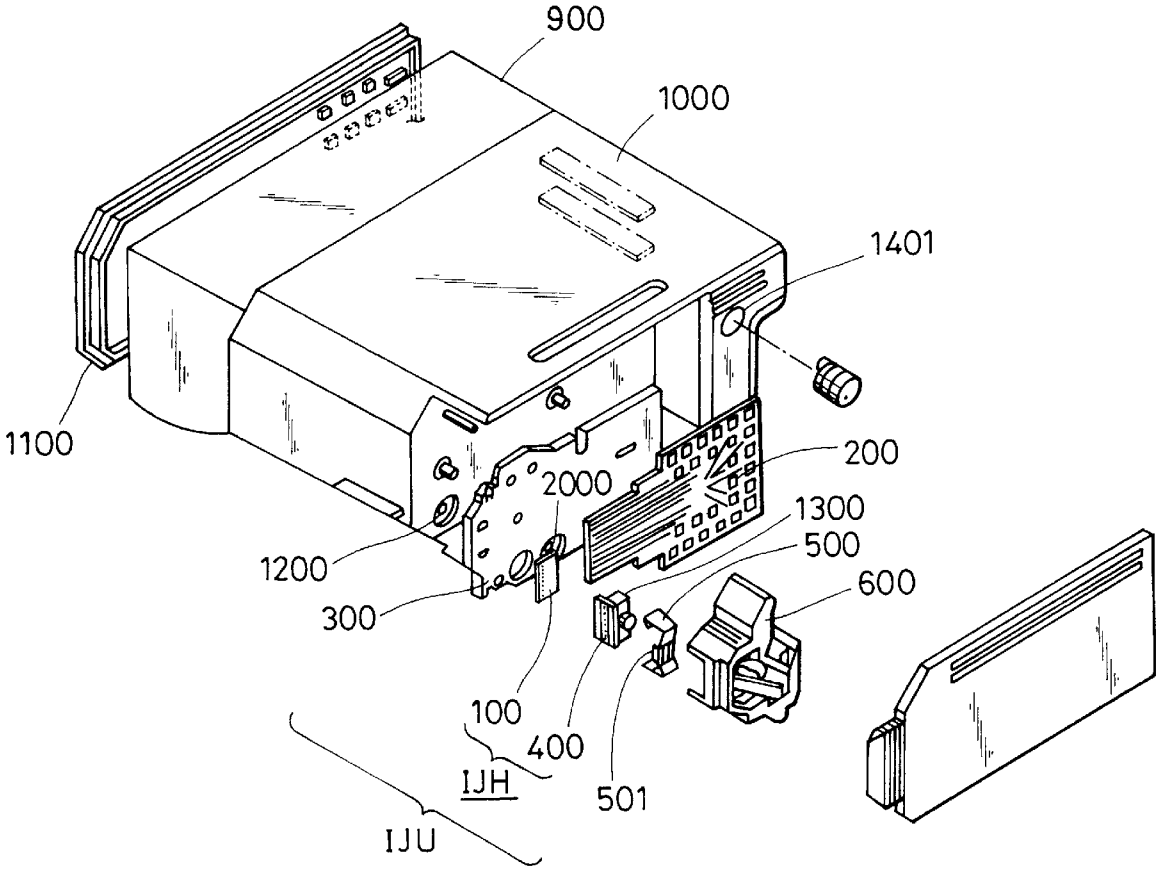
FIG. 1 is an assembly view of an ink jet cartridge according to the present invention.
Figure 2:
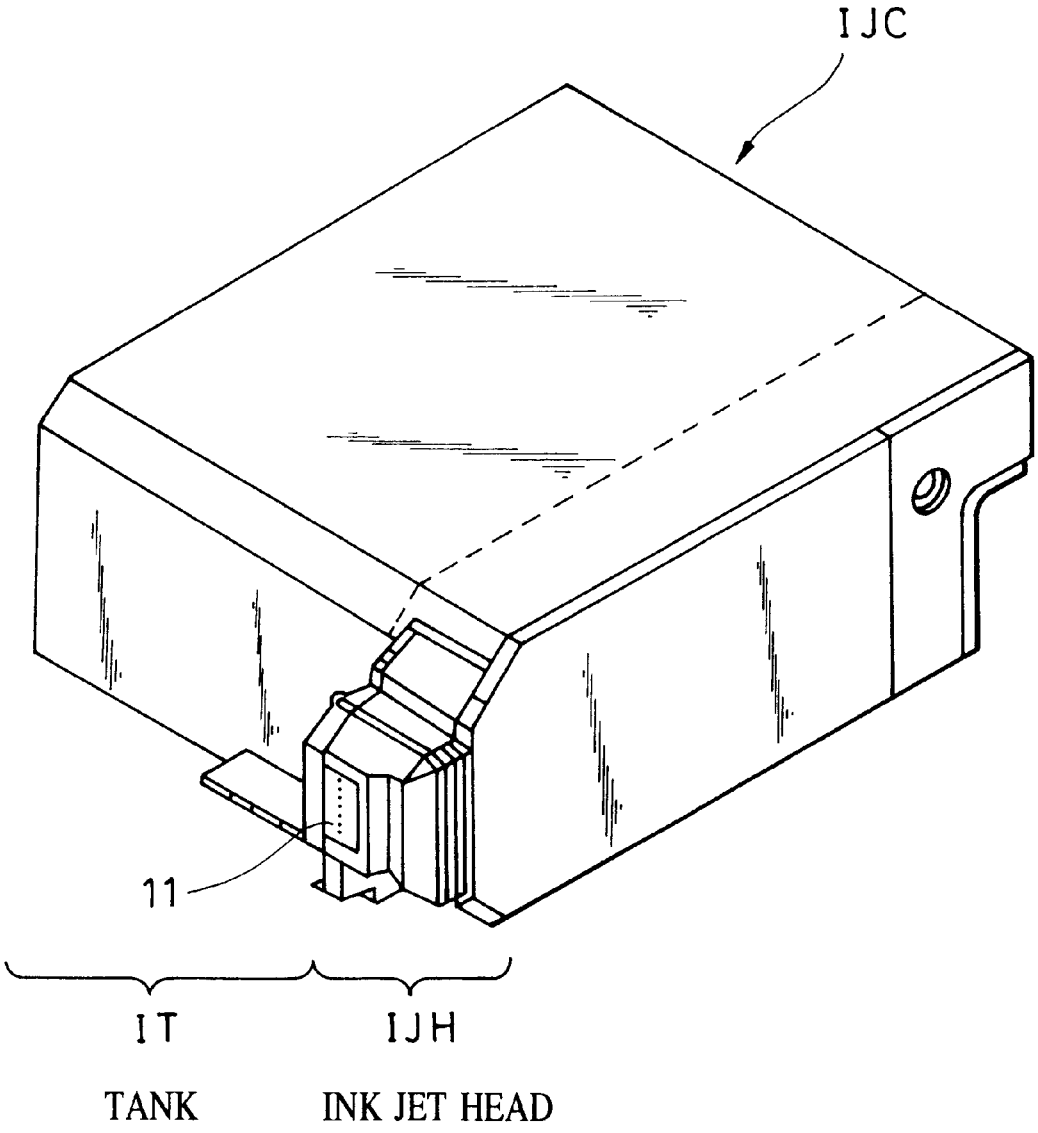
FIG. 2 is a perspective view of an ink jet cartridge according to the present invention.
Figure 3:
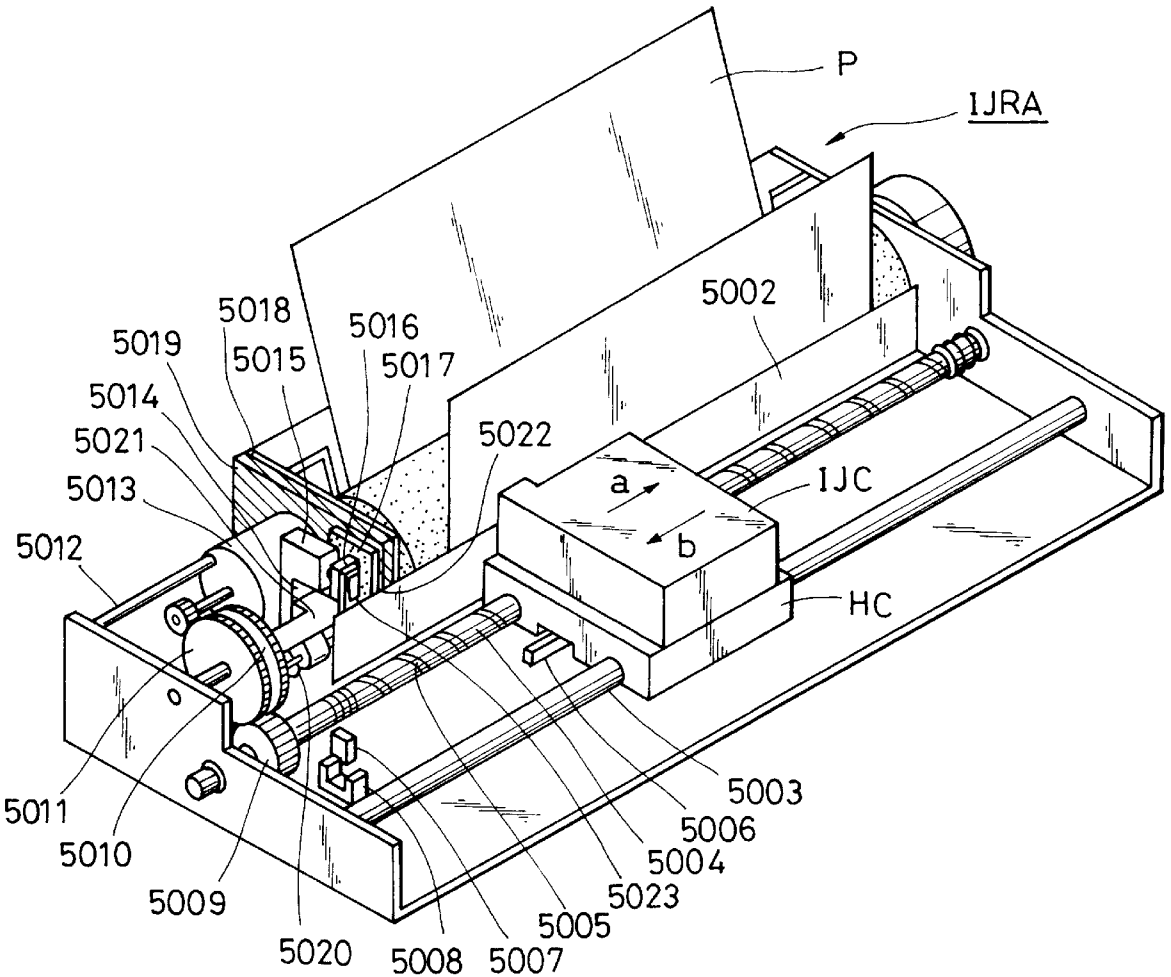
FIG. 3 is a drawing illustrating an ink jet recording apparatus according to the present invention.

FIGS. 1 to 3 are schematic representations of an ink jet unit "IJU", an ink jet head "IJH", an ink jet cartridge "IJC", and a body of an ink jet recording apparatus "IJRA" according to an embodiment of the present invention. The configuration of each part will be described below in accordance with the drawings.

In this embodiment, as shown in a perspective view of FIG. 2, the ink jet cartridge "IJC" is an integration of the ink jet unit "IJU" and an ink tank "IT" in which the ink-accommodating level is large. This ink jet cartridge "IJC" is fixed and supported by a carriage positioning means, has electrical connections formed in the body of an ink jet recording apparatus "IJRA", and is disposable by being detachable from the carriage.

The ink jet unit "IJU" is a bubble jet system unit in which recording is carried out by an electro-thermal converting element which generates thermal energy to cause ink in a membrane to boil corresponding to an electrical signal.

In FIG. 1, a heater board 100 (first base body) is formed of electro-thermal converting elements (jetting heaters) disposed on a silicon substrate in a plurality of columns and electrical connections composed of, for example, aluminum for supplying electrical power to the heaters, by a depositing technique. On this base body, a temperature sensor is formed to sense head temperature. An electrical connection board 200 is used for the heater board 100.

In a top board with grooves 1300, separating walls (grooves) for separating a plurality of ink pathways and a common liquid chamber to accommodate ink for supplying ink to each ink pathway are provided. The top board with grooves 1300 is integrally molded of an orifice plate 400 having a plurality of discharging orifices 11 corresponding to each ink pathway. The integrally molded material is preferably a polysulfone resin, however, other materials for molding may be used.

A supporting member 300 made of a metal, for example, which flatwise supports the electrical connection board 200 on the back, is a bottom board of the ink jet unit. An urging member 500 is an "M"-shaped urging spring which slightly urges the common liquid chamber by the center of the "M", while intensively linearly urging a portion of the pathway of ink, preferably a region adjacent to the discharging orifice, by a front hanging portion 501. The heater board 100 and the top board 1300 are fixed and secured to the supporting member 300 by an intensively urging force of the urging spring 500 and the front hanging portion 501 by inserting the heater board 100 and the top board 1300 between the supporting member 300 and the spring 500 which is engaged with the supporting member 300 on the back when leg portions of the spring are inserted through a hole of the supporting member 300.

The ink tank is formed of a cartridge body 1000, an ink absorber 900, and a lid member 1100 for sealing the ink absorber 900 after it is inserted from a side surface of the cartridge body 1000 opposite the surface that the ink jet unit "IJU" is placed. From a supplying inlet 1200, ink is supplied to the ink jet unit "IJU". A communicating hole 1401 is formed in the lid member to allow the inside of the cartridge to communicate with ambient air.

In this embodiment, the top board 1300 is formed of an ink resistant resin such as a polysulfone resin, a polyethersulfone resin, a polyphenyleneoxide resin, or a polypropylene resin, by a simultaneous integral molding with the orifice plate portion 400 in a die.

As described above, since an ink supplying member 600, the top board and the orifice plate, and the ink tank body 1000 are integrally molded, respectively, not only assembly with high accuracy can be achieved but also quality in mass production can be substantially improved. Since the number of parts is also reduced, required performance can certainly be applied.

FIG. 3 is a drawing illustrating an ink jet recording apparatus "IJRA" according to the present invention. In the apparatus, a carriage "HC" having a pin (not shown) is reciprocated in the direction "a" and "b" by engaging with a spiral groove 5004 of a lead screw 5005 rotating corresponding to forward and backward rotation of a driving motor 5013 through power transmitting gears 5011 and 5009. An urging plate for paper 5002 urges paper against a platen 5000 over the moving range of the carriage. A photo-coupler 5007, 5008 is a home-position sensing device for changing the direction and the like of a motor 5013 by sensing the existence of a lever 5006 of the carriage in this area. A member 5016 supports a cap member 5022 for capping the front surface of the recording head, and an absorbing member 5015 for absorbing within this cap absorbs and restores the recording head through an inner aperture 5023. A member 5019 enables a cleaning blade 5017 to move backward and forward, and a body supporting plate 5018 supports these two members. A well-known cleaning blade other than this structure can also be applied to the embodiment. A lever 5012 for initiating the absorbing is transferred in association with the movement of a cam 5020 engaged with the carriage, and moved and controlled by the driving motor through known transmission means such as a clutch.

In this embodiment, capping, cleaning, and absorbing and restoring are carried out at the respective positions by means of the lead screw 5005, when the carriage is located at the home position. Any configuration can be applied to the embodiment as long as required performance is carried out at known timing. The above-mentioned configurations independently or in a combination are excellent inventions, and preferable embodiments to the present invention.

This apparatus also has a driving signal supplying device for driving an ink jetting pressure-generating element.

Figure 4:
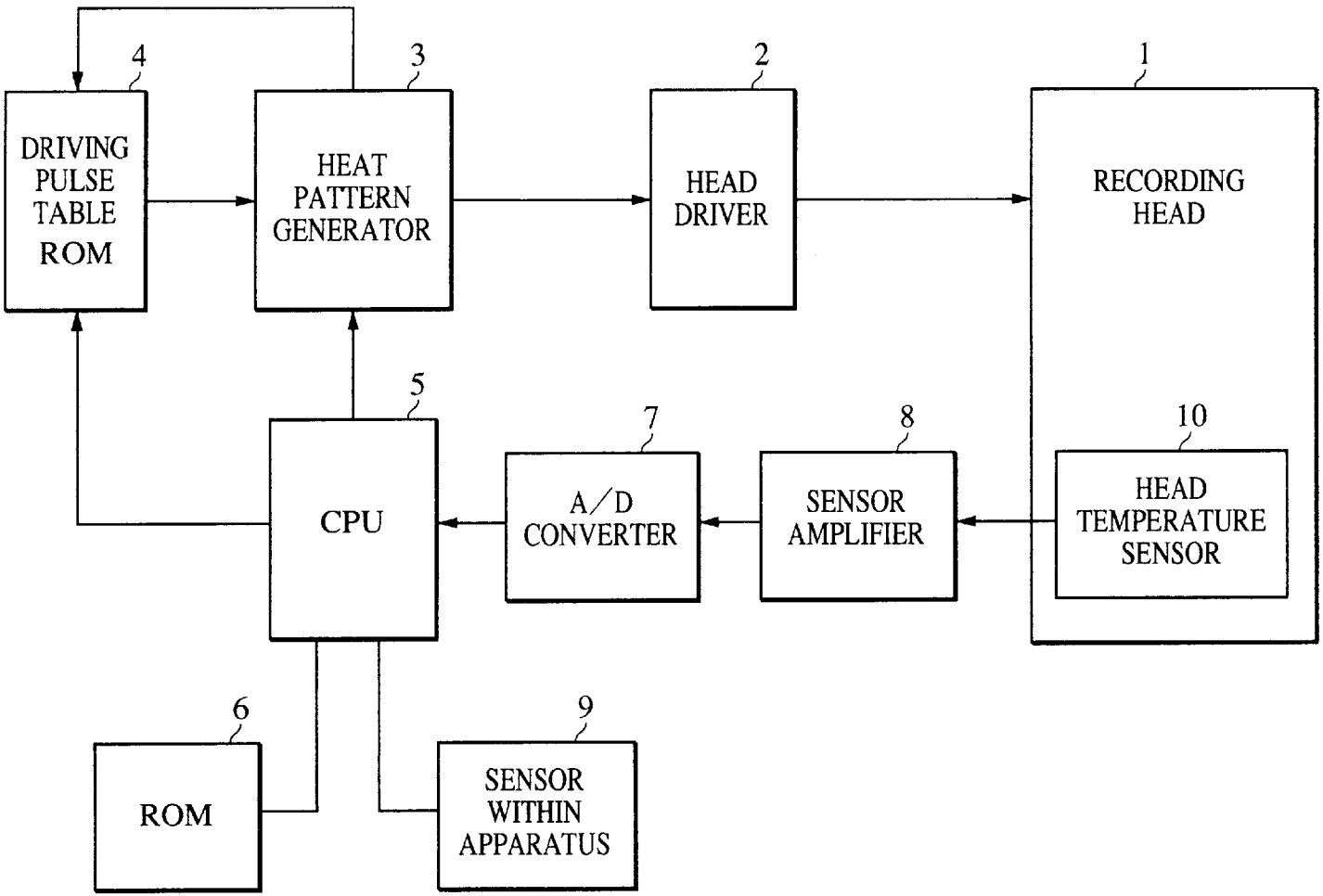
FIG. 4 is a block diagram showing an overall driving of a recording apparatus according to the present invention.

FIG. 4 is a block diagram showing an overall driving of a recording apparatus according to the present invention. A heat pattern generator 3 is a circuit to form a driving pulse waveform to which data output of a driving pulse table ROM 4 connects. The driving pulse table ROM 4 forming a pulse generating device in advance stores a plurality of driving pulse tables (temperature and driving pulse waveform trains). In each driving table, driving pulse waveforms are systematically stored according to each temperature range of the head. The temperature range of the head is selected by a temperature range-specifying signal from the heat pattern generator 3 forming a pulse-generating device. Normally, the driving pulse waveform corresponding to the present head temperature is selected. The temperature range-specifying signal is produced by the heat pattern generator 3 synchronously with a recording timing based on a head temperature-range number produced by a CPU 5 forming the pulse-generating device.

The producing of the head temperature-range number by the CPU 5 will be described. Within a bubble jet recording head 1, a head temperature sensor 10 as a sensing device for sensing the head temperature is disposed. The output signal of the sensor 10 is amplified by a sensor amplifier 8, and digitized by an A/D converter 7 to be fed to the CPU 5. When the CPU 5 reads the temperature, it determines the temperature range number by comparing the sensed head temperature with the temperature-range table in a ROM 6, prepared in the CPU 5 in advance by connecting to the ROM 6. The CPU 5 instructs the temperature-range number corresponding to this temperature range to the heat pattern generator 3. Since the series of processes is performed every several ten microseconds while recording, a driving pulse substantially corresponding to the present head temperature is generated to drive the bubble jet head 1 through a head driver 2.

The driving pulse table is selected by a table-specifying signal produced by the CPU 5 among a plurality of driving pulse tables stored in the driving pulse table ROM 4. The table-specifying signal is produced by the CPU 5 corresponding to correction accuracy at an offset correction for the temperature sensor 10 disposed in the bubble jet head 1. In this embodiment, the head temperature sensor 10 utilizes a diode sensor having characteristics as shown below.

$$Vf=A\ t+B$$

A=−4.5±0.1 [mV/° C.]

B=1150±50 [mV]

Accordingly, since the offset, that is, variations in "B", is approximately ±10° C., unless the correction is performed, these variations affect the temperature sensing accuracy just as they are.

The method for the offset correction of the head sensor 10 will be described below in accordance with FIG. 4 and the flow charts in FIG. 5.

When the power source of the printer is on (S100), the bubble jet head 1 is checked to determine whether it is placed (S101). If the head 1 is recognized, a temporary offset value "B" is determined, assuming the temperature indicated by the head sensor 10 is equal to an ambient temperature indicated by a temperature sensor 9 within the apparatus (S102).

Since the temperature sensor 9 within the apparatus is placed adjacent to the carriage disposed to the bubble jet head 1 of the printer body (recording apparatus), it indicates the same temperature as that of the head, if the head 1 has been placed in the carriage.

The head temperature sensor 10, however, indicates differently from the temperature sensor 9 within the apparatus, when the head stored in a different place is placed, or the printer is turned on again after being turned off from recording. The temperature sensor 9 within the apparatus can be assumed to be substantially accurate because it utilizes a thermistor sensor with high accuracy.

Then, a print command is checked (S103), when the print is commanded (S104), a recording is performed to check the next print command. When the print is not commanded, a lapse of time since the last temperature correction process is calculated. When a predetermined time has elapsed (S105), estimation of increasing and decreasing temperature characteristics of the sensor and the offset correction process are performed (S106).

In the offset correction process, an offset value "B" is determined by assuming the present head temperature by means of measuring the decreasing temperature characteristic (occasionally increasing temperature characteristic) of the head sensor 10 and an ambient temperature by the temperature sensor 9 within the apparatus, based on the characteristic data stored in advance. This offset correction process is performed every several tens of minutes, the accuracy will be improved with the number of the processes performed. When the recording is not carried out, when the head temperature is equalized to the ambient temperature in several hours, the correction is completed to accurately determine an offset value "B".

Since all the above-mentioned offset processes are performed by the CPU 5, the CPU 5 can command a table specifying signal to select a specific table, as will be described, from a plurality of tables by determining the correction accuracy by itself.

Figure 8:
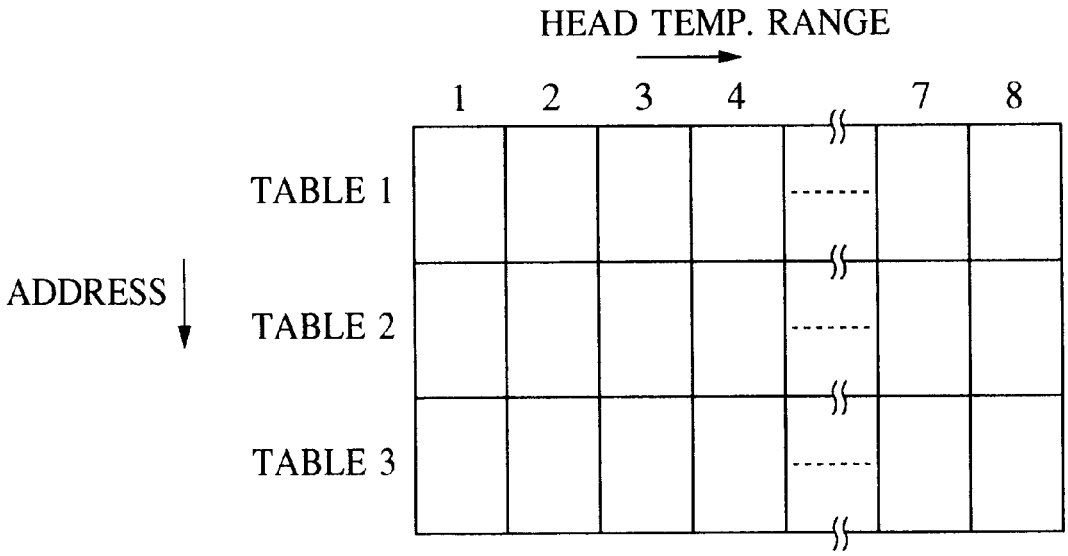
FIG. 8 is a chart illustrating an address map of a driving pulse ROM.

Next, the driving pulse table ROM 4 will be described. FIG. 8 is a memory map of the driving pulse table ROM 4. In addresses in order from the first, pulse waveform information of a driving signal of each train, that is a table 1, a table 2, and a table 3, is stored, respectively. In each table, in order from a lower address, a driving signal waveform corresponding to each temperature range, in order from low temperature, is stored.

Figure 9A:
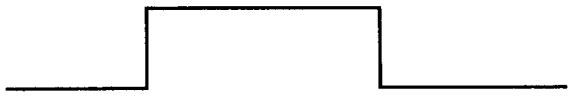
FIGS. 9A and 9B are charts illustrating waveforms of driving pulses.
Figure 9B:
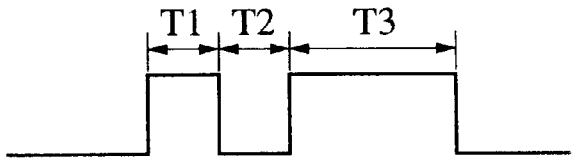

A pattern of the driving pulse waveform will be described in accordance with FIGS. 7 and 9. FIG. 9A is a schematic representation of a driving pulse waveform when single pulse-driving is used, while FIG. 9B shows a driving pulse waveform when double-pulse driving is used. In double pulse driving, T1, T2, and T3 are defined as a pre-pulse width, a rest section, and a main-pulse width, respectively.

Figure 7A:
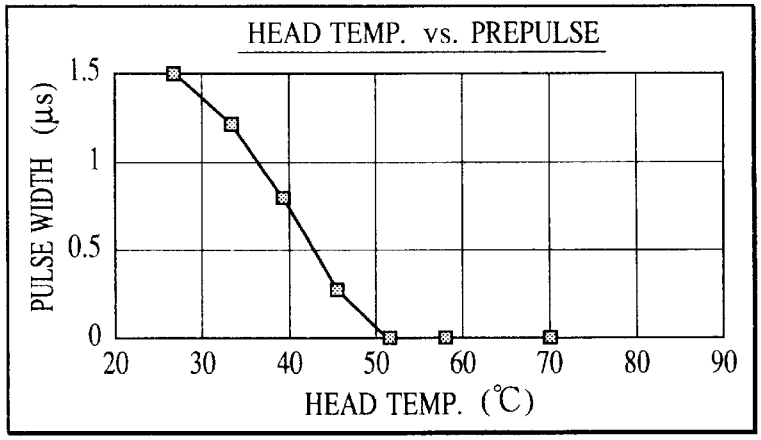
FIG. 7A is a graph showing relation between the head temperature and a pre-pulse.

FIG. 7A is a graph showing the pre-pulse width with respect to the head temperature. Up to about 50° C., the pre-pulse width is gradually reduced. Since over the temperature range, the pre-pulse width becomes zero, it will become single-pulse driving. FIG. 7C shows jetting volumes, which is constant in the double-pulse driving section, while increasing with the head temperature in the single-pulse driving section. In explanatory notes of FIG. 7B, "fixed" shows a conventional main-pulse width T3, while "Tth" shows a main-pulse width when being controlled by Tth control. When a threshold bubbling value at 25° C. in the conventional case is defined as T (25), T3 is determined by the following equation in the whole temperature range.

$$T1+T3=T(25)*k^2 \quad \text{(equation 1)}$$

Therefore, the sum of pulses is at all times constant. The constant "k" is a parameter for specifying a margin for a stable jetting, and it is preferably 1.05 to 1.30 derived from practical experience. On the other hand, in the Tth control, T3 is determined to follow the equation below.

$$T1+T3=Tth * k^2 \quad \text{(equation 2)}$$

Figure 6:
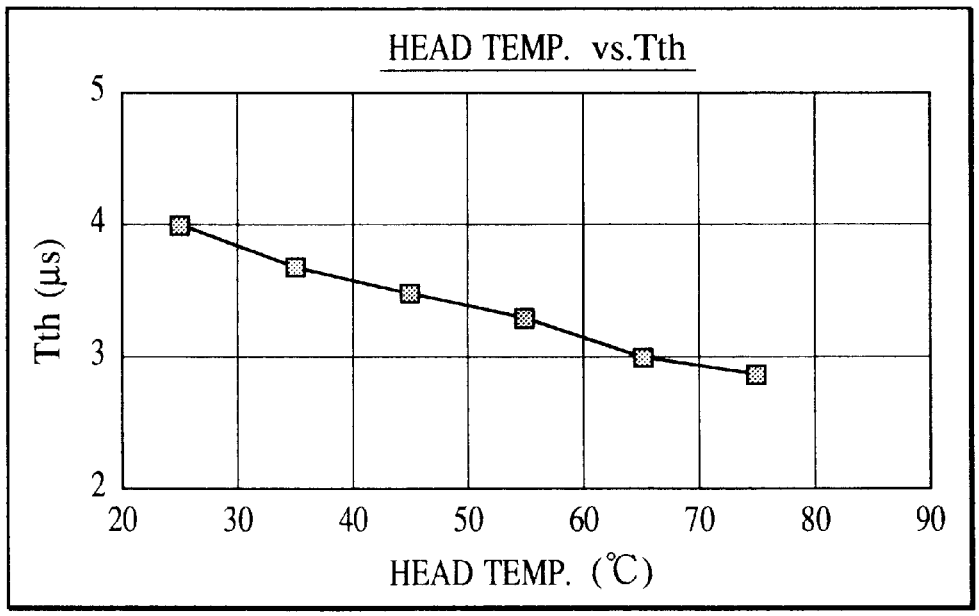
FIG. 6 is a graph showing relation between the head temperature and a bubbling threshold value Tth.

Since the "Tth" decreases with increase in the head temperature, as shown in FIG. 6, and the sum of the pulses is also reduced, the driving energy to the bubble jet head 1 when the head temperature is increasing can be restrained. The characteristic of "Tth" shown in FIG. 6 is obtained by the condition of the single-pulse driving. When a rest section "T2" between the pre-pulse and the main-pulse ranges between 2 to 3 μs as in this embodiment, however, "Tth" is similar to the sum of two pulses as the equation 2 with regard to the jetting characteristic.

If "T2" is 5 μs or more, since cooling amount for heat generation in the "T2" section cannot be negligible, there may be cases of failure of jetting unless "T3" is set at 3.0 μs or more. In this case, the driving may be changed to the double-pulse driving without changing "Ti" corresponding to the head temperature, and a bubbling threshold value t3 of the main-pulse width may be obtained to preferably determine T3 as below.

$$T3=(T1+t3)*k^2-T1$$

Figure 7B:
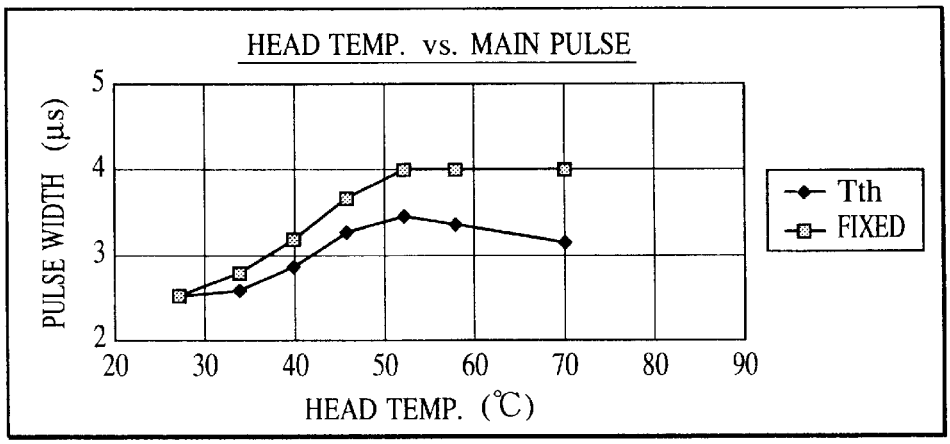
FIG. 7B is a graph showing relation between the head temperature and a main-pulse.
Figure 7C:
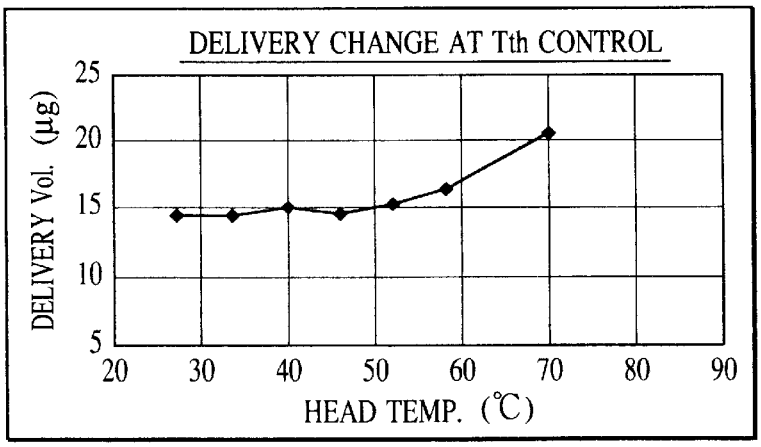
FIG. 7C is a graph showing relation between the head temperature and discharging volume when controlling by Tth control.

In this embodiment, three tables (head temperature and driving pulse waveform train) are prepared in the driving pulse table ROM 4, in which table 1 is a conventional driving pulse table according to "equation 1", and table 3 is perfectly applied to "Tth" according to "equation 2", while table 2 is an intermediate table between table 1 and table 3, and in table 2, intermediate main-pulse widths are stored between the main-pulse widths of "Tth" and the fixed main-pulse widths shown in FIG. 7B.

Figure 10:
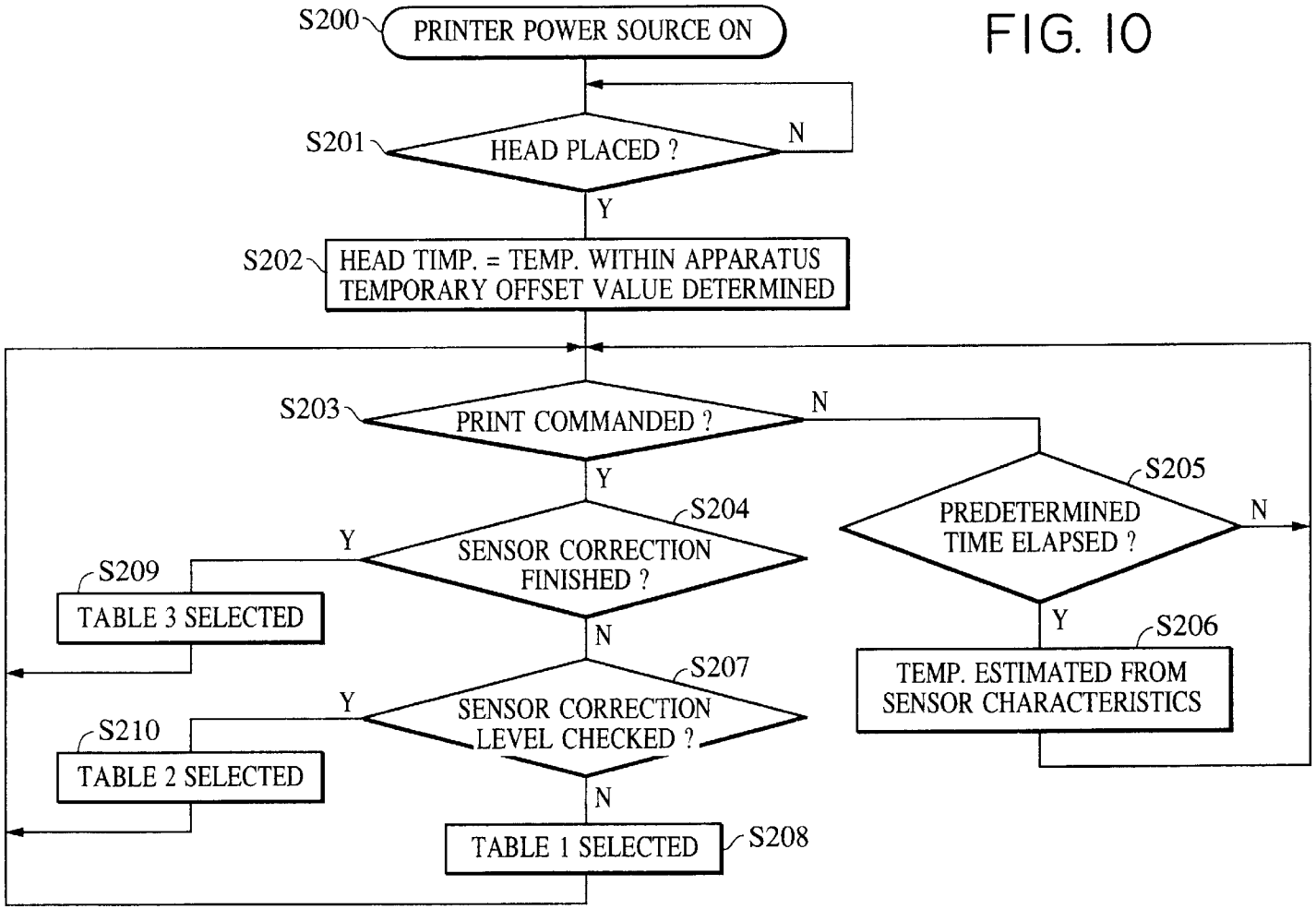
FIG. 10 is a flowchart showing an offset correction of a head temperature sensor.

FIG. 10 shows a sequence for selecting a table from these three tables corresponding to correction accuracy of a temperature sensing element of the head. As described in accordance with FIG. 5, when the power source of the printer is on (S200), the head is checked to determine whether it is placed (S201). If the head is recognized, a temporary offset value is determined, assuming the head temperature is equal to the temperature within the apparatus (S202). Then, a print command is checked (S203), when the print is not commanded, a lapse of time since the last correction process is checked (S205). When a predetermined time has elapsed, the offset correction process is performed (S206).

On the other hand, when the print is commanded in the step S203, the correction accuracy is determined. That is, it is determined whether the correction of the sensor is finished (S204). When it is finished, the above-mentioned table 3 is selected (S209). When it is not finished in the step S204, the correction accuracy (level) is checked (S207). When the level is more than a predetermined value, table 2 is selected (S210). When the level is less than the predetermined value, the table 1 is selected (S208).

In this sequence, table 1 is selected when the correction accuracy is low, and the table 2 is selected when the correction accuracy is improved to some extent, while table 3 is selected when the correction is finished at last.

Figure 11:
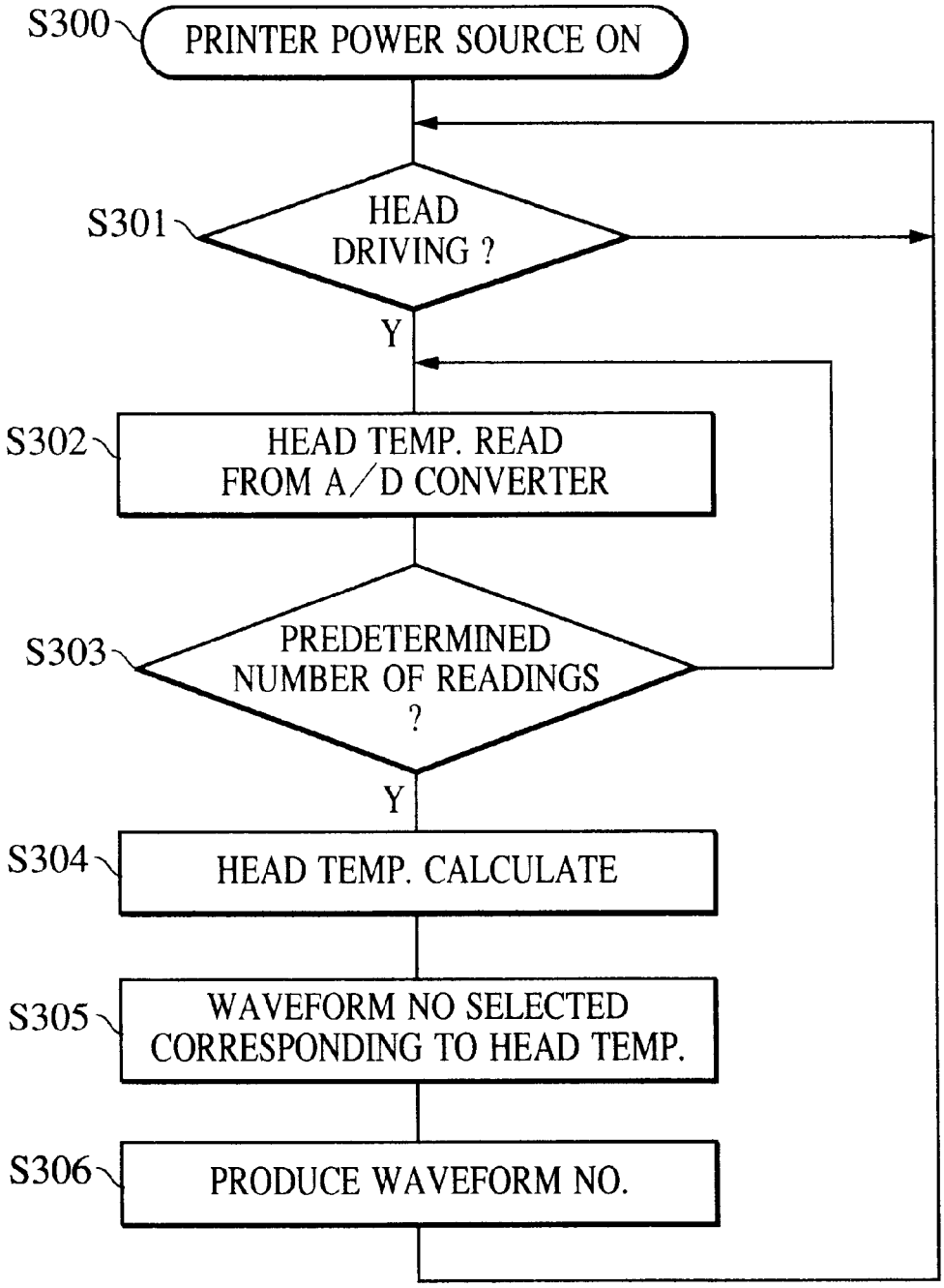
FIG. 11 is a flowchart showing a sequence for selecting the pulse width waveform for each temperature.

After the table is selected according to the correction accuracy, a driving signal waveform is selected from each table corresponding to each head temperature in accordance with a sequence shown in FIG. 11.

When the power source is on (S300) and the head is driven (S301), the head temperature is read from the temperature sensor through the A/D converter (S303). When the predetermined number of readings have been carried out, the head temperature is calculated (S304), and the driving pulse waveform is selected from the selected table corresponding to the head temperature (S305) to produce driving signal waveform information (S306). Based on the information, a recording element is driven by driving means.

In a manner described above, recording can be carried out without any failure in ink jetting or any printing degradation at all times. Since the driving energy can be restrained to suppress the increase in head temperature when the correction process of the head temperature sensor 10 is finished, recording can be optimally achieved maintaining throughput.

(Other Embodiments)

The head temperature sensor 10 in the head for sensing the head temperature utilizes a diode sensor in the embodiment mentioned above. It, however, may be a resistance sensor. Although the temperature is sensed by measuring output of the head temperature sensor 10 in the embodiment, a temperature sensor need not be used. For example, the head temperature may be estimated by a recording duty cycle and a rest time obtained from the CPU, if the temperature-increasing characteristic in a recording duty cycle time at an ambient temperature and the temperature-decreasing characteristic in a rest time are measured in advance.

Although the driving pulse width is controlled as a means for restraining the head driving energy with increase in head temperature in the embodiment, the driving energy may also be controlled by a head driving voltage as long as the bubbling threshold voltage characteristic of the head driving power-source with respect to the head temperature is measured in advance.

The following advantages can be achieved according to the present invention described above:

(1) the throughput can be improved;

(2) since a radiating block can be eliminated or miniaturized, the head can be miniaturized and the cost can be reduced;

(3) since jetting efficiency is improved, electric power saving and lowering cost by reducing capacity of the power source can be achieved;

(4) since increase in temperature can be restrained compared to a conventional apparatus, reliability in the printer as well as the head can be improved;

(5) running costs are reduced by reduced consumption of ink.

What is claimed is:

1. An ink jet recording apparatus comprising:

a recording head having a recording element for jetting ink and sensing means for sensing head temperature;

pulse generating means which generates a pulse signal to be applied to said recording element of said recording head such that the pulse width of the pulse signal corresponds to the head temperature; and driving means for driving said recording element of said recording head by the pulse signal generated by said pulse generating means, wherein said pulse generating means is capable of generating a plurality of signal trains of pulse widths in accordance with the head temperature; and means for changing the signal train corresponding to correction accuracy of an output of said temperature sensing means of said recording head.

2. An ink jet recording apparatus according to claim 1, wherein said pulse generating means has a plurality of tables containing data of the signal trains of pulse widths in accordance with each temperature of said recording head and selects a predetermined pulse width from the tables.

3. An ink jet recording apparatus according to claim 1, wherein the head temperature is a temperature obtained by effecting correction on an output of said temperature sensing means of said recording head.

4. An ink jet recording apparatus according to claim 1, wherein each signal train of pulse widths follows an equation yielding a pulse width with respect to head temperature.

5. An ink jet recording apparatus comprising:

sensing means for sensing temperature of a head;

driving pulse storing means storing a plurality of driving pulse waveform data in accordance with each range of the head temperature;

driving pulse generating means which reads driving pulse waveform data in accordance with head temperature from said driving pulse storing means to generate a driving pulse waveform; and driving means for driving said head corresponding to the driving pulse waveform data read by said driving pulse generating means, a plurality of said driving pulse storing means are provided to select desired driving pulse storing means corresponding to correction accuracy of a temperature characteristic of said sensing means for sensing head temperature.

6. An ink jet recording apparatus according to claim 5, wherein a plurality of said driving pulse storing means include at least one driving pulse storing means which stores driving pulse waveform data in which head driving energy decreases with increase in head temperature.

7. An ink jet recording apparatus comprising:

sensing means for sensing head temperature;

driving voltage storing means storing a plurality of driving voltage data corresponding to each range of the head temperature; and driving voltage generating means which reads driving voltage data corresponding to a head temperature from said driving voltage storing means to generate a driving voltage, a plurality of said driving voltage storing means are provided to select desired driving voltage storing means corresponding to correction degrees of a temperature characteristic of said sensing means for sensing head temperature.

8. An ink jet recording apparatus according to claim 7, wherein a plurality of said driving voltage storing means include at least one driving voltage storing means which stores driving voltage data in which head driving energy decreases with increase in head temperature.

9. An ink jet recording apparatus according to claim 5 or 7, wherein said sensing means for sensing head temperature is one of a diode sensor and a resistance sensor disposed in the head.

10. An ink jet recording apparatus according to claim 5 or 7, wherein said sensing means for sensing head temperature is temperature estimating means for estimating the head temperature.

11. An ink jet recording apparatus according to claim 10, wherein said temperature estimating means estimates the head temperature from a recording duty cycle time and a rest time.

12. A method of driving an ink jet recording apparatus having a recording head including a recording element for jetting ink and sensing means for sensing head temperature, said driving method comprising the steps of:

generating a pulse signal to be applied to said recording element such that the pulse width of the pulse signal corresponds to head temperature;

driving said recording element of said recording head by the pulse signal; and generating a plurality of signal trains of pulse widths, each of said plurality of signal trains corresponding to a head temperature and selectable in accordance with correction accuracy of an output of said sensing means for sensing head temperature.

13. A method according to claim 11, further comprising the step of selecting the signal train by selecting a table from a plurality of stored tables containing data of the signal trains of pulse width.

14. A method of driving an ink jet recording apparatus having a recording head including a recording element for jetting ink and sensing means for sensing head temperature, said driving method comprising the steps of:

generating a driving voltage to be applied to said recording element such that the magnitude of the driving voltage corresponds to head temperature;

driving said recording element of said recording head by the driving voltage; and generating a plurality of signal trains of different voltage magnitudes, each of said plurality of signal trains corresponding to a head temperature, and selectable in accordance with correction accuracy of said sensing means for sensing head temperature.

15. A method according to claim 14, further comprising the step of:

selecting the signal by selecting a table from a plurality of stored tables containing data of the signals of voltage magnitude.

16. A method according to claim 11 or 14, further comprising the step of:

providing as the sensing means for sensing head temperature one of a diode sensor and a resistance sensor disposed in the head.

17. A method according to claim 11 or 14, further comprising the step of:

providing as the sensing means for sensing head temperature a temperature estimating means for estimating the head temperature.

18. A method according to claim 17, further comprising the step of:

estimating the head temperature from a recording duty cycle time and a rest time.

* * * * *

UNITED STATES PATENT AND TRADEMARK OFFICE

CERTIFICATE OF CORRECTION

PATENT NO. : 6,547,357 B1
DATED : April 15, 2003
INVENTOR(S) : Tsuruoka

Figure 5:
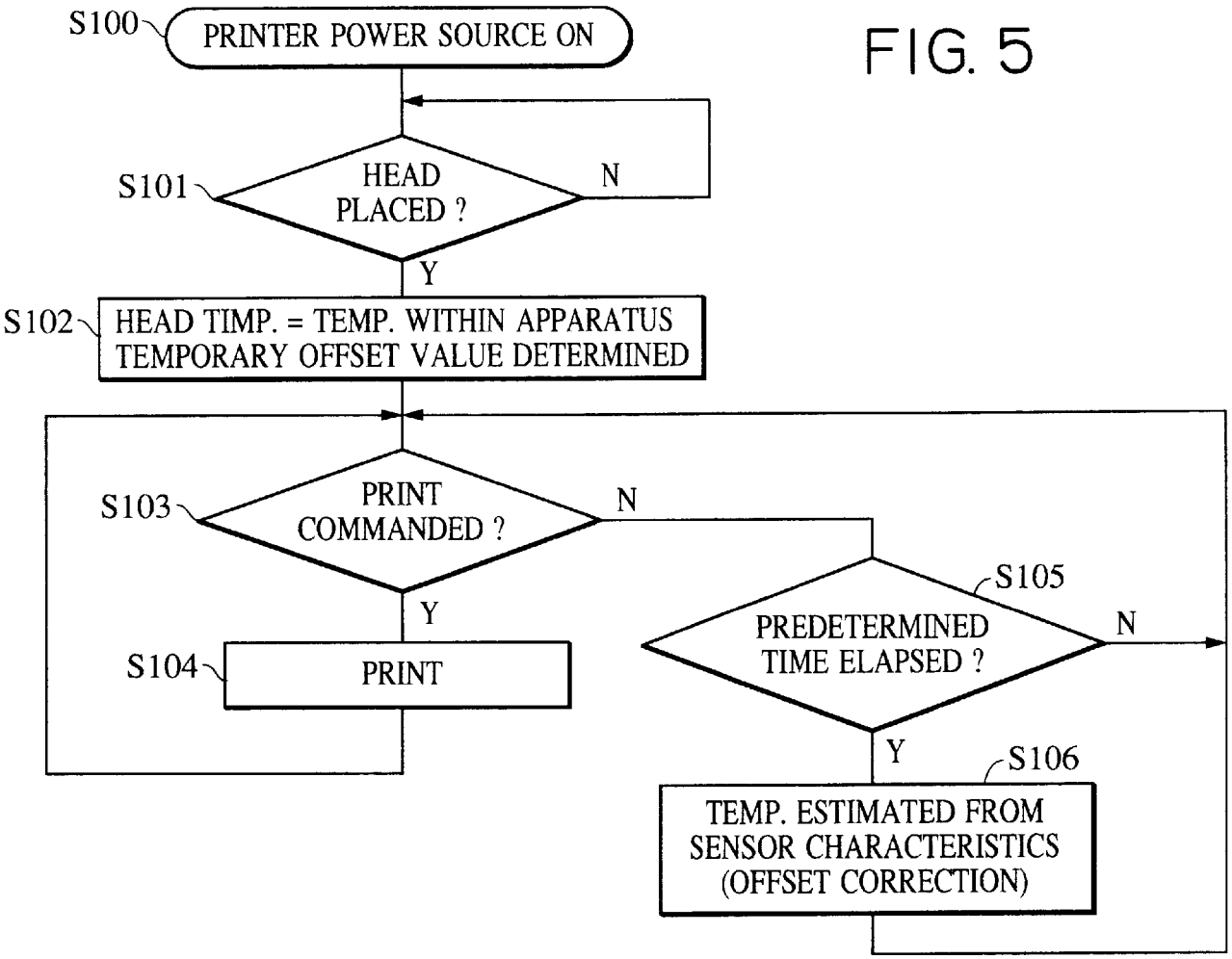
FIG. 5 is a flow chart showing an off-set correction of a head temperature sensor.

It is certified that error appears in the above-identified patent and that said Letters Patent is hereby corrected as shown below:

Drawings,
Sheet 5 of 10, Fig. 5, step S102, "TIMP." should read -- TEMP. --.
Sheet 9 of 10, Fig. 10, step S202, "TIMP." should read -- TEMP. --.

Column 1,
Line 28, "material, this" should read -- material. This --.

Column 2,
Line 57, "to" should be deleted.

Column 3,
Line 17, "controlling" should read -- controlled --.
Line 24, "sensor;" should read -- sensor; and --.

Column 4,
Line 17, "that" should read -- where --.
Line 40, "rotation" should read -- rotations --.
Line 60, "and" (first occurrence) should be deleted.

Column 5,
Line 21, "producing" should read -- production --.

Column 7,
Line 20, ""Ti"" should read -- "T1" --.

Column 10,
Lines 46 and 51, "claim 11" should read -- claim 12 --.

Signed and Sealed this

Thirtieth Day of December, 2003

JAMES E. ROGAN
*Director of the United States Patent and Trademark Office*